US006283335B1

(12) United States Patent
Young et al.

(10) Patent No.: US 6,283,335 B1
(45) Date of Patent: Sep. 4, 2001

(54) OIL SPRAYER WITH HAND OPERATED AIR PUMP

(75) Inventors: Michael W. K. Young, Astoria; Jochen Schapers, New York; Wei Young, Flushing, all of NY (US)

(73) Assignee: Progressive International Corp., Kent, WA (US)

( * ) Notice: Subject to any disclaimer, the term of this patent is extended or adjusted under 35 U.S.C. 154(b) by 0 days.

(21) Appl. No.: 09/568,598

(22) Filed: May 10, 2000

Related U.S. Application Data

(60) Provisional application No. 60/134,116, filed on May 14, 1999, and provisional application No. 60/154,680, filed on Sep. 17, 1999.

(51) Int. Cl.[7] ..... B67D 5/06; B67D 5/58; B65D 83/14

(52) U.S. Cl. ..... 222/182; 222/189.1; 222/402

(58) Field of Search ..... 222/401, 402, 222/402.12, 402.11, 153.11, 153.14, 182–189.1

(56) References Cited

U.S. PATENT DOCUMENTS 3,460,719 * 8/1969 O'Donnell et al. ..... 222/402.12
3,955,720 * 5/1976 Malone ..... 222/396
4,264,037 * 4/1981 Nozawa ..... 239/333
5,267,674 * 12/1993 von Schuckmann ..... 222/401
5,649,645 * 7/1997 Demarest et al. ..... 222/402.12

* cited by examiner

*Primary Examiner*—Kevin P. Shaver
*Assistant Examiner*—Stephanie L. Willatt
(74) *Attorney, Agent, or Firm*—John R. Benefiel

(57) ABSTRACT

A liquid sprayer incorporating an air pump to force pressurized air into the interior of a receptacle. The air pump is operated, by stroking of a cover. The cover has an opening allowing finger access to the plunger of a spray nozzle in one rotated position of the cover, the cover being held in that position. In another rotated position the cover is released for stroking. A piston on the cover projects into a central tubular portion on the cap with valving sealing allowing air to be drawn past the piston and forced into the receptacle. The spray nozzle is offset from the tubular portion and the plunger is accessible through the cover without removing the same.

7 Claims, 8 Drawing Sheets

FIG-1
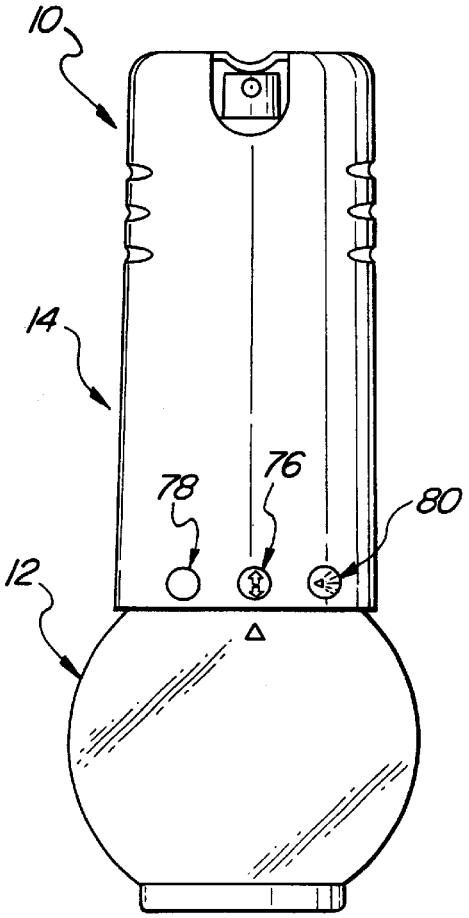
FIG-3
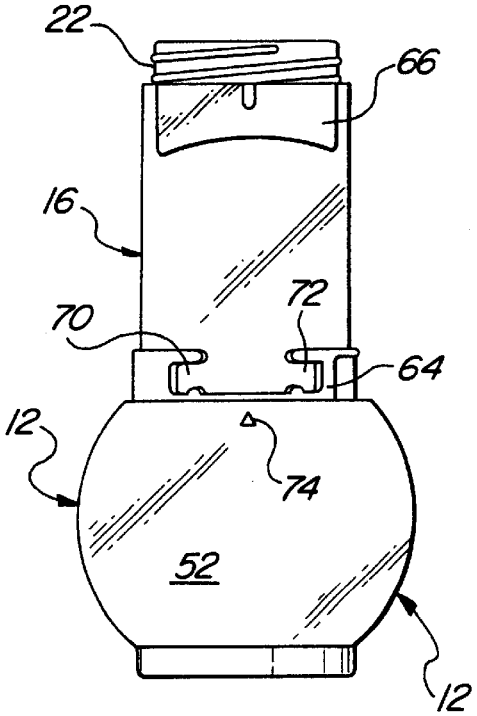
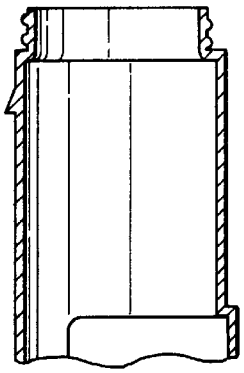
FIG-3B
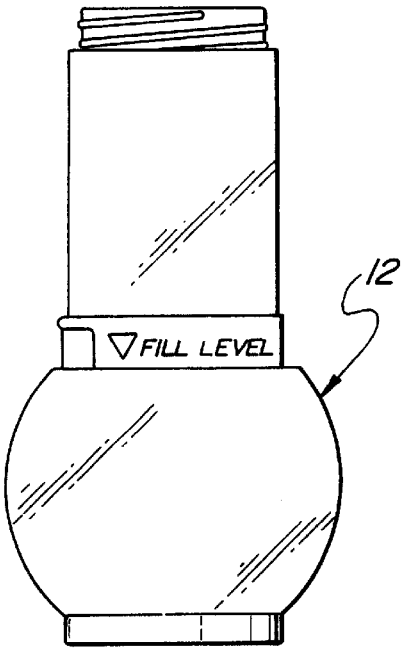
FIG-3A

FIG-20
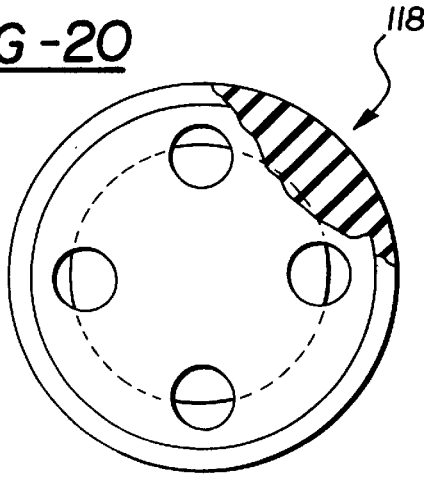
FIG-21
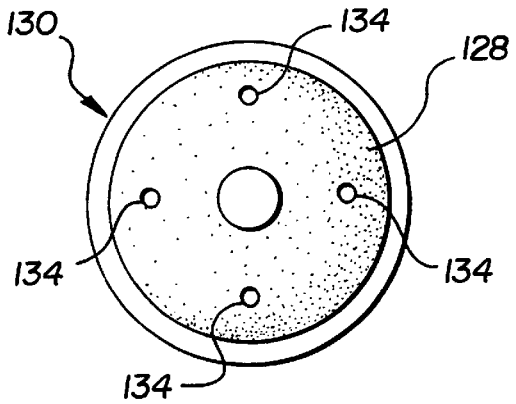
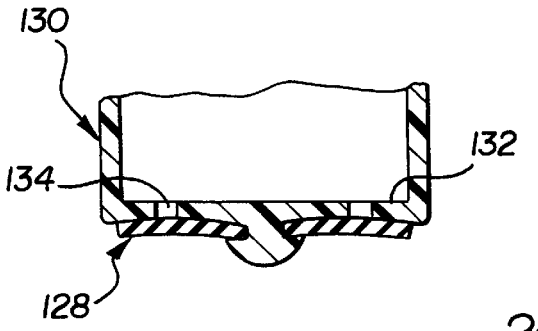
FIG-22
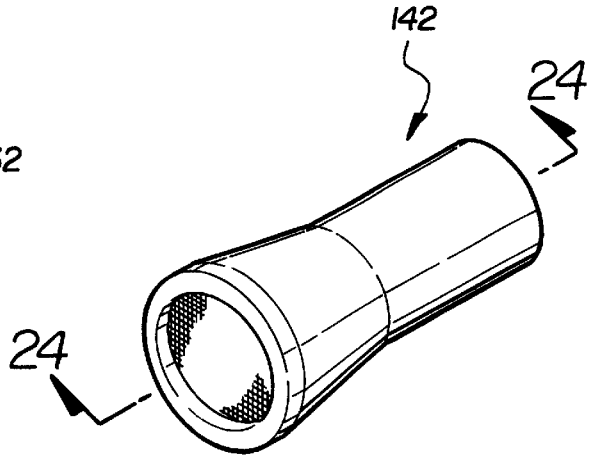
FIG-23
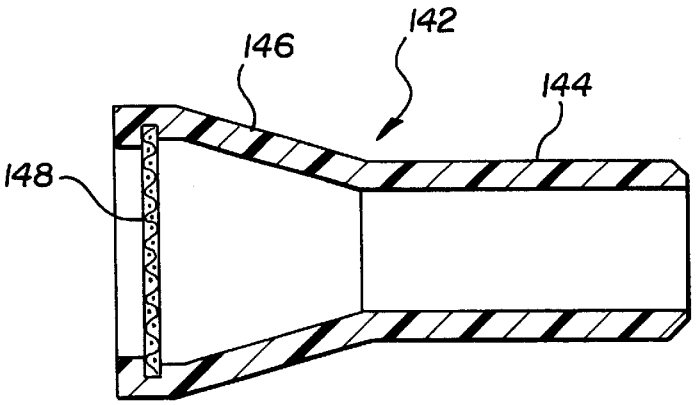
FIG-24

OIL SPRAYER WITH HAND OPERATED AIR PUMP

CROSS REFERENCE TO RELATED APPLICATION

The application claims benefit from previously filed provisional patent applications, U.S. Ser. No. 60/134,116, filed May 14, 1999 and U.S. Ser. No. 60/154,680, filed Sep. 17, 1999.

BACKGROUND OF THE INVENTION

This invention concerns sprayers and more particularly sprayers adapted for kitchen use in which olive oil can be sprayed from a receptacle by air compressed in the receptacle by a hand pump mounted to the top of the receptacle.

Devices to spray a liquid from a receptacle by the use of air pressure developed by a built in hand pump have previously been devised. See U.S. Pat. No. 4,077,442, issued on Mar. 7, 1978 for an "Arrangement in Liquid Sprayer Containers".

That design uses a cap which is stroked to force air into the receptacle back through a spray nozzle, the air pressure developed opening a check valve to allow air to be forced into the receptacle, which is then retained in the receptacle by closing of the spray nozzle check valve. After the cap is removed, finger depression of the spray nozzle causes the check valve to be opened, and the retained air pressure forces the liquid to be sprayed out through the spray nozzle.

This arrangement is effective, but requires the cap to be removed in order to spray the liquid.

It is the object of the present invention to provide an air pressure liquid sprayer using a built in hand pump operated with a receptacle cover which does not require removal of the cap to spray a liquid from a spray nozzle at the top of the receptacle.

SUMMARY OF THE INVENTION

These and other objects of the present invention which will be understood upon a reading of the following specification and claims are achieved by a receptacle cap screwed onto the receptacle and formed with a central pumping tube extending from the top of the cap downwardly into the receptacle interior.

A hollow cover is slidably received over the cap and onto an interfit neck portion of the receptacle. The cover is formed with a pumping piston slidable into the pumping tube and having a first check valve mounted at its lower end in an adapter piece attached to the piston lower end.

A second check valve is mounted to the lower end of the pumping tube which has an opening therein to receive compressed air as the cover and piston are stroked, allowing compressed air to be forced into the receptacle and retained by the second check valve. The first check valve allows a fresh charge of air to pass beneath a piston seal as the cover pulled up.

A separate opening to one side of the pumping tube is provided in the cap, receiving a spray nozzle and valve plunger, with a draw tube extending to the bottom of the receptacle allowing oil to be forced out of the nozzle by air pressure in the receptacle when the valve plunger is depressed.

The spray nozzle is exposed by rotation of the cover from a cover pumping position to bring an opening in the cover into registry with the spray nozzle, allowing a user the finger access needed to depress the spray nozzle valve plunger.

The cover has an inner protrusion located to catch on a raised ridge on the receptacle neck in a spraying and stored position to prevent cover removal, but allowing passing through a gap in the ridge when the cover is rotated to a pumping position. An upper ridge on the receptacle neck catches the protrusion when the cover is stroked upwardly, providing an upper limit to the stroke motion to prevent escape of the cover when pumping.

Ribs may be formed on the inside of the cover to guide the cover on the receptacle neck when it is being stroked to prevent tipping of the cover as it is stroked The spray nozzle valve is enclosed when the cover is rotated to either the stored or pumping positions.

The pump cap can be removed and replaced with a pouring spout cap to allow use as a melted butter pourer.

DESCRIPTION OF THE DRAWINGS

FIG. 1 is a front view of the oil sprayer according to the present invention.

FIG. 3 is a front view of the receptacle of the sprayer of FIG. 1 with a cover and receptacle cap both removed.

FIG. 3A is a rotated elevational view of the receptacle showing the fill level indication.

FIG. 3B is a fragmentary sectional view of the receptacle neck.

FIG. 20 is an end view of the piston and O-ring shown in FIGS. 19A and 19B.

FIG. 21 is an end view of the tube and sealing disc associated therewith to create a one way valving action.

FIG. 22 is a sectional view of the tube and disc shown in FIG. 21.

FIG. 23 is a perspective enlarged view of a filter installed on the draw tube.

FIG. 24 is a view of the section 24—24 taken in FIG. 23.

DETAILED DESCRIPTION

Figure 2:
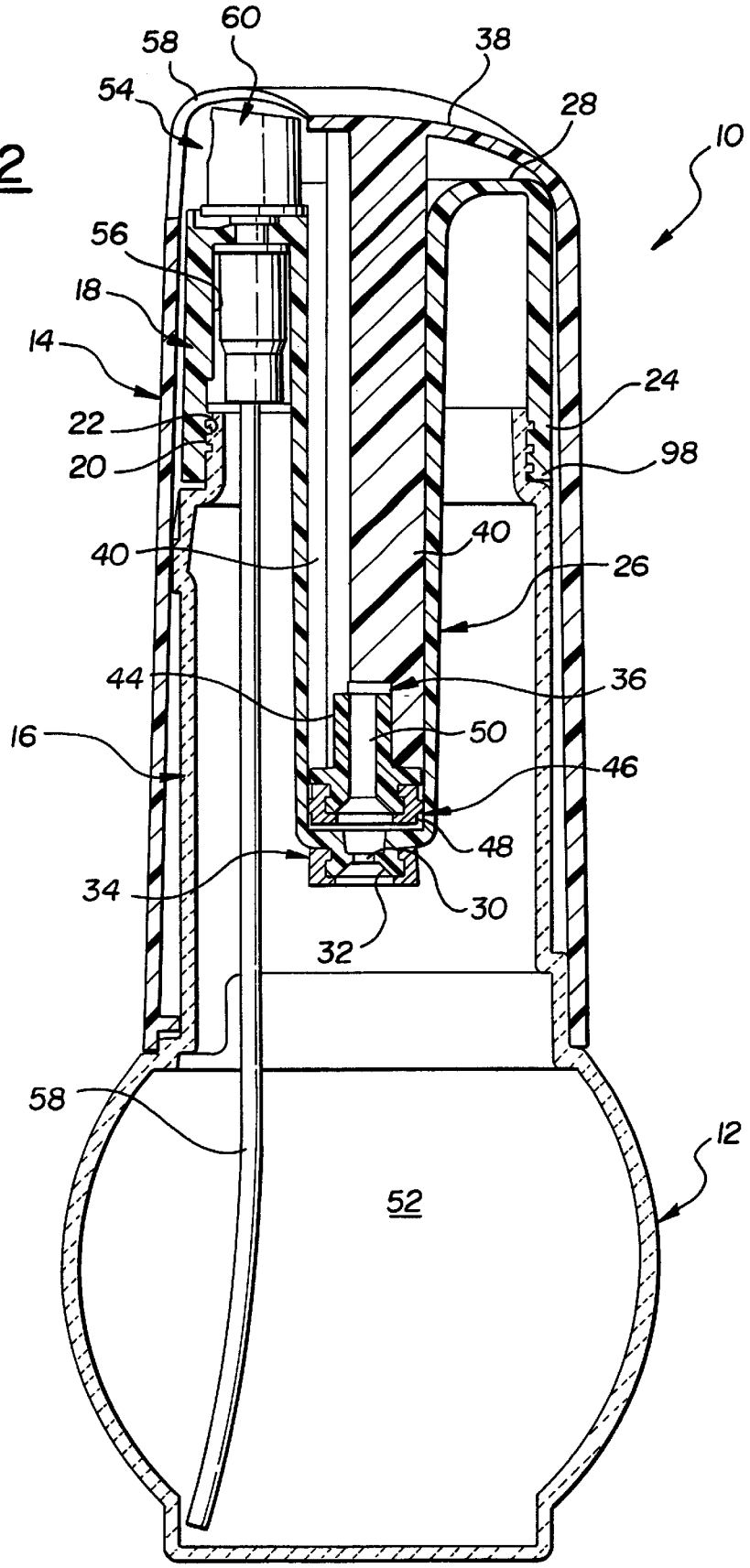
FIG. 2 is a sectional view of the sprayer shown in FIG. 1.

In the following detailed description, certain specific terminology will be employed for the sake of clarity and a particular embodiment described in accordance with the requirements of 35 USC 112, but it is to be understood that the same is not intended to be limiting and should not be so construed inasmuch as the invention is capable of taking many forms and variations within the scope of the appended claims.

Referring to the Drawings, FIG. 1 is an external view of the sprayer 10 which includes a receptacle 12 and an inverted cup shaped cover 14 molded of opaque plastic enclosing an upright neck portion 16 of the receptacle 12 and a molded plastic cap 18 screwed onto threads formed onto the upper lip of the neck 16. The cap 18 has mating threads 22 formed into the interior of a shirt portion 24 thereof.

The cap 18 has integrally molded central pumping tube 26 descending downwardly from the center of a top 28, an opening 30 formed in a bottom feature 32 at the bottom of the tube 26. A first elastomeric check valve 34 is pressed on the feature 32.

The cover 14 has a piston structure 36 integral with a top portion 38 descending down into the interior of the central tube 26.

Figure 16:
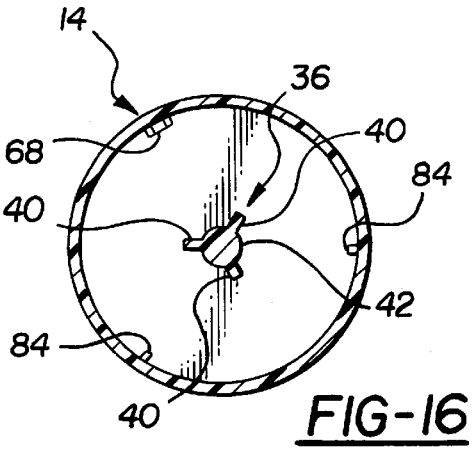
FIG. 16 is a transverse sectional view of the cover.

The piston structure 36 is formed by crossing lengthwise webs 40 integral with a center portion 42 (See FIG. 16).

A valve adapter 44 at the bottom of the piston 36 holds a combination piston sealcheck valve 46 of an elastomeric material. A skirt 48 on the seal-check valve 46 seals by engaging the straight sidewall of the central tube 26 to allow pumping of air by stroking of the cover 14.

Air is prevented from moving past the piston during downstroking of the cover 14 by the check valve 46, but air moves through an opening 50 in adapter 44 on the upstroke as the valve 46 opens.

Air forced into the receptacle interior 52 is retained by the closing of the first check valve 34, which opens on the downstroke to allow air to be forced into the receptacle interior 50.

A commercially available spray nozzle valve assembly 54 is mounted in an upwardly tubular pocket 56 integrally formed in the cap 18 at a radially offset location to one side of the tube 26. A draw tube 58 extends down into the space 52 to a point close to the bottom of the receptacle 12, allowing a liquid to be forced up to the spray nozzle valve assembly 54 and sprayed out when air pressure exists in the space 52.

Figure 4A:
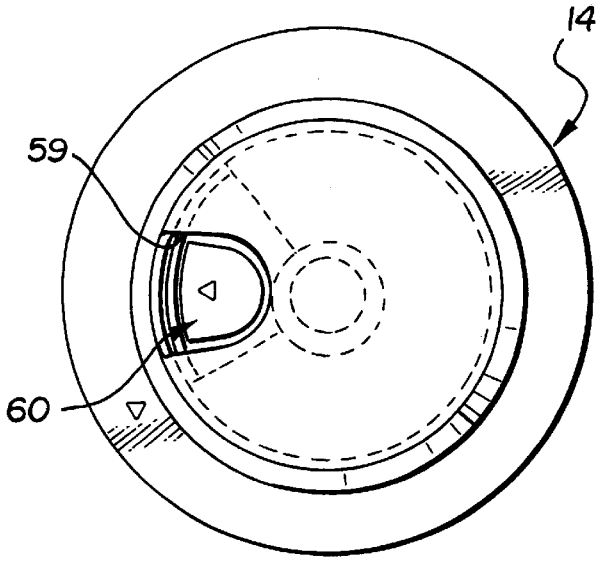
FIGS. 4A–4C are top views showing the three rotated positions of the cover.

An opening 59 in the top portion 38 of the cover 14 exposes a plunger 60 of the spray nozzle valve assembly when the cover 14 is rotated to the open position (FIG. 4A), allowing finger access for spraying by depression thereof in the well known manner.

Figure 4B:
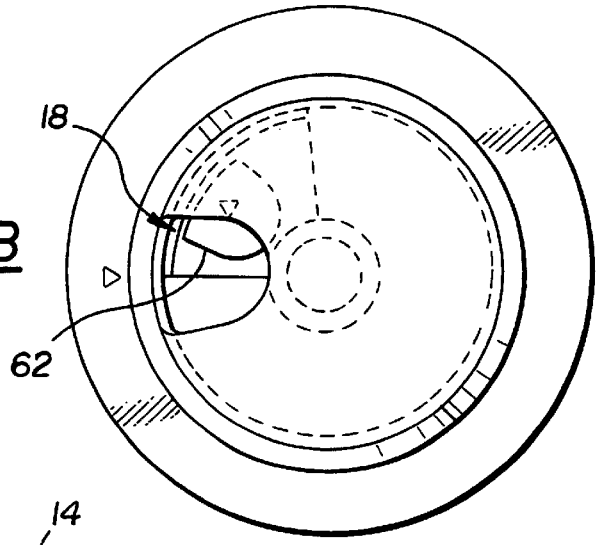
Figure 4C:
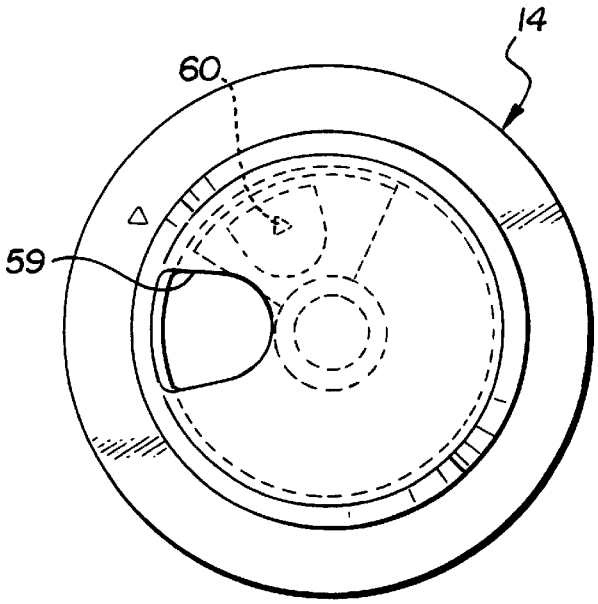
Figure 5:
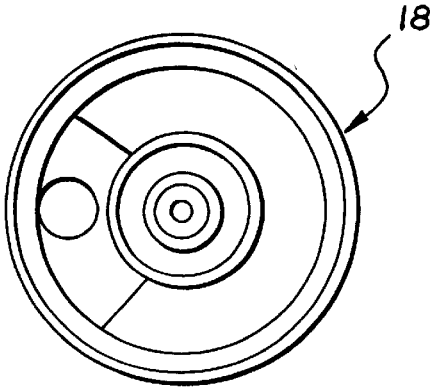
FIG. 5 is a bottom view of the receptacle cap.
Figure 6:
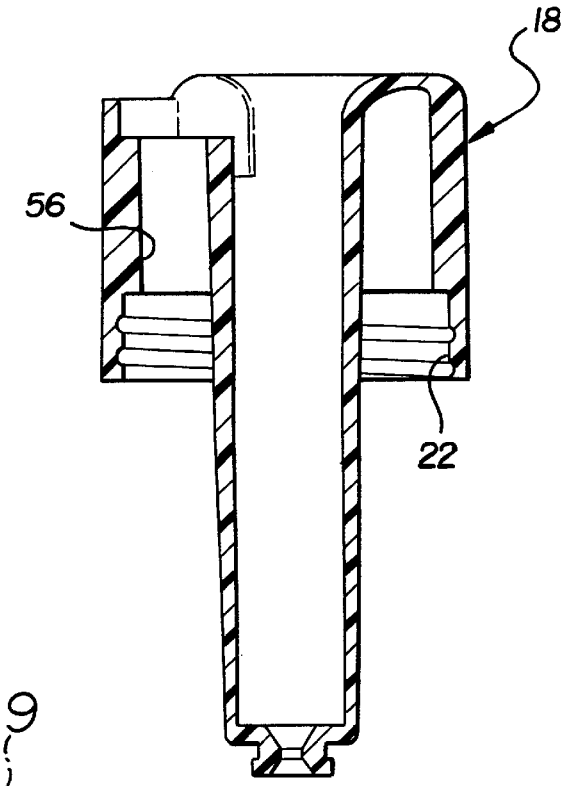
FIG. 6 is a sectional view of the receptacle cap.
Figure 7:
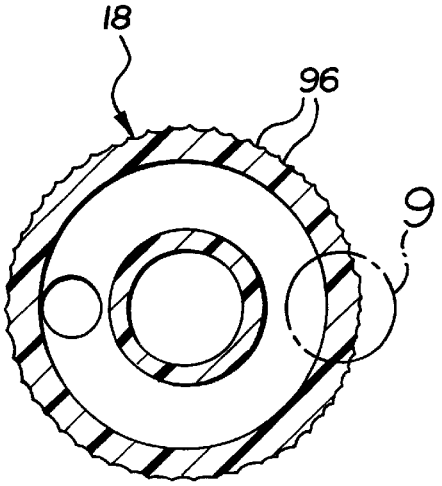
FIG. 7 is a view of a transverse section taken through the cap receptacle.
Figure 9:
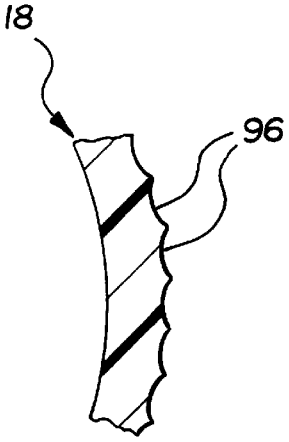
FIG. 9 is a fragmentary enlarged view of the sidewall of the receptacle cap.
Figure 8:
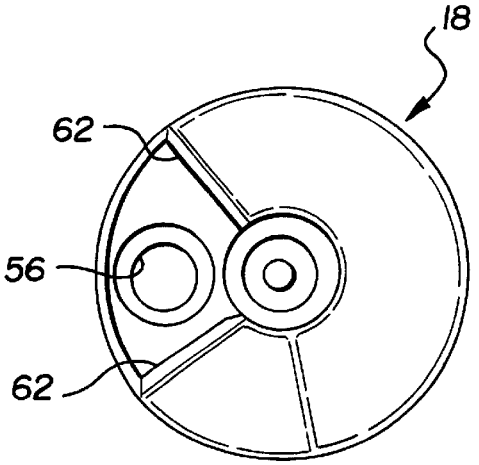
FIG. 8 is a top view of the receptacle cap.

The cover 14 can be rotated to a closed position (FIG. 4C) which encloses the plunger 60 and a recess 62 in the cap 18 in which the plunger 60 is disposed.

In a central rotated position (FIG. 4B) the cover 14 can be stroked for pumping.

FIG. 3 shows that the neck 16 of the receptacle 12 has raised areas 64 and 66 molded thereto which cooperate with a button feature 68 (FIG. 16) on the inside of the cover 14. The feature 68 prevents stroking when received in recesses 70, 72 corresponding to the open and closed rotated position of the cover 14.

Alignment marks 74, 76 indicates the pumping position, and open and closed marks 80, 78 are also provided.

Grip aiding grooves 82 are formed in the upper sides of the cover 14.

Shallow tapered ribs 84 provide guidance of the cover on the neck 16 to prevent tipping during stroking.

Figure 10:
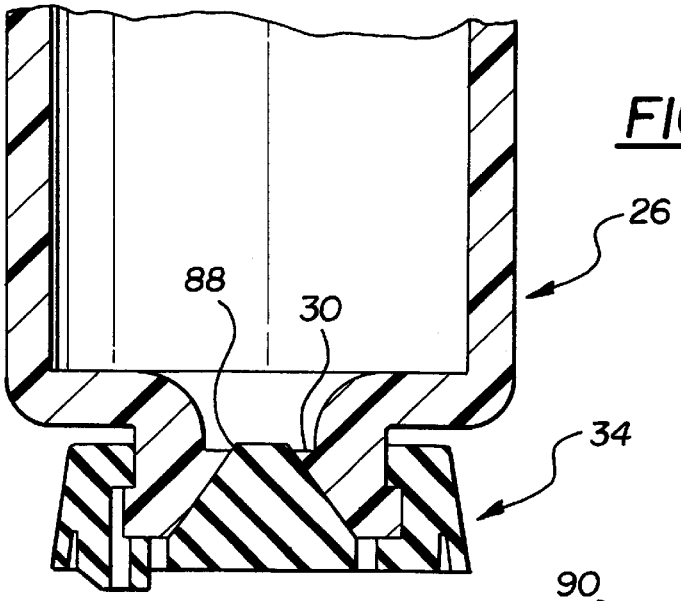
FIG. 10 is an enlarged sectional view of the pumping tube bottom end, and the first check valve installed thereon.
Figure 11:
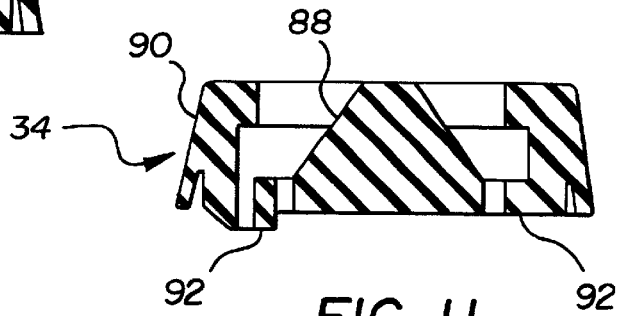
FIG. 11 is a sectional view of the molded elastomeric first and second check valves.
Figure 12:
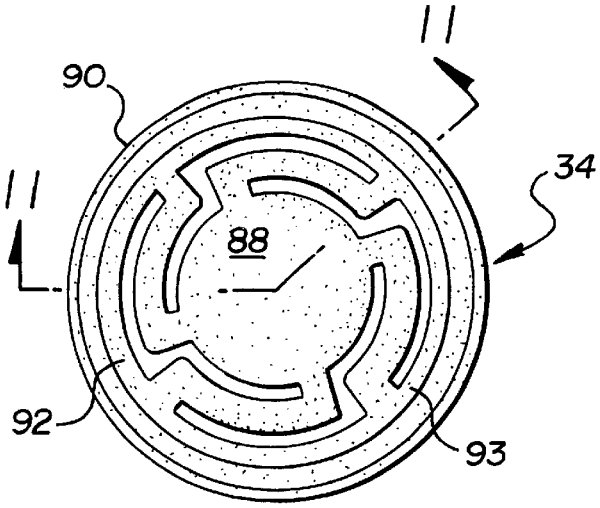
FIG. 12 is a bottom view of the check valve.

FIGS. 10–12 show the check valve 34 details, (which is the same as check valve 46). Check valve 32 includes a conical valving position 88, a sealing skirt portion 90, and a resilient connecting spring portions 92 allow axial movement of the valving portion 88 on and off the opening 30 for performing the valving function. A suitable rubber or other elastomeric material may be used for the check valve 34.

Figure 13:
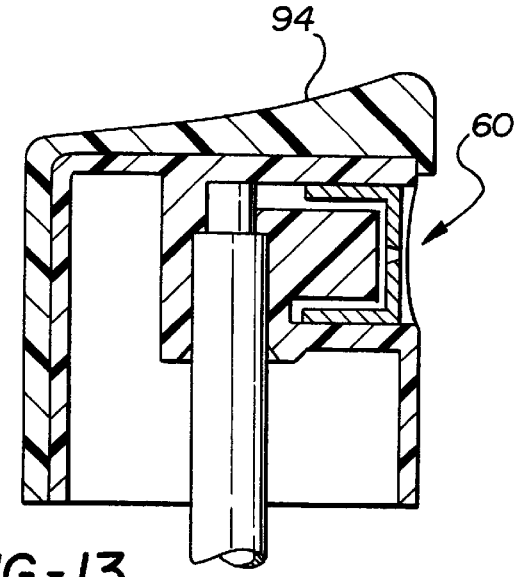
FIG. 13 is an enlarged sectional view of a spray nozzle plunger with an optional hood installed.
Figure 14:
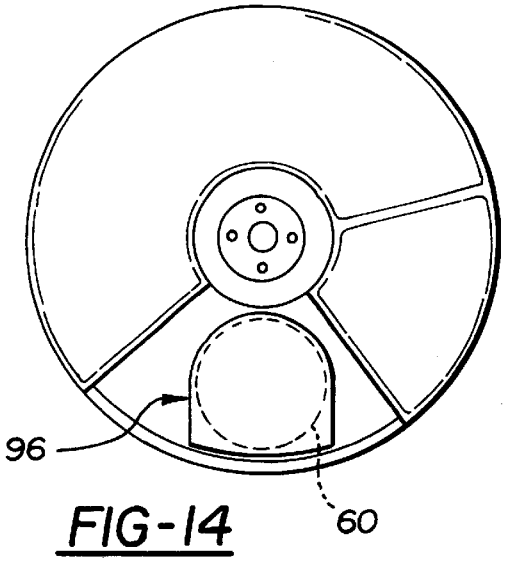
FIG. 14 is a top view of the cap and spray nozzle hood.
Figure 15:
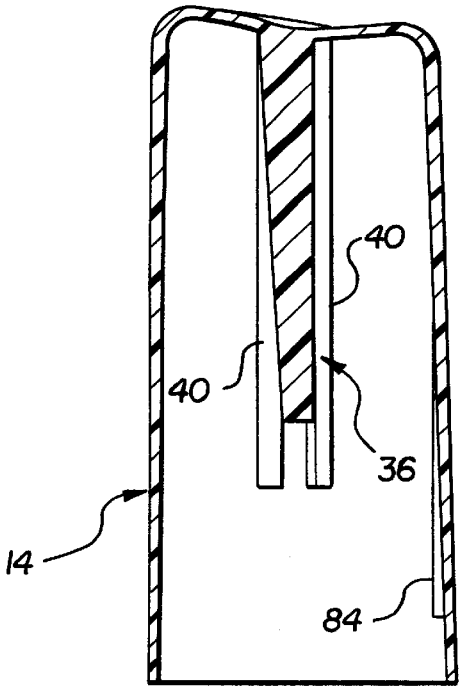
FIG. 15 is a lengthwise sectional view of the cover.

A hood 94 (FIGS. 13, 14) can be placed over the spray nozzle valve plunger 60 to space a person's finger above the outlet, and may be shaped to prevent excessive turning in the recess 62 of the cap 18.

The cap 18 may be fluted at 96 for nonslip gripping.

A suitable gasket 98 is held in the cap 18 located to abut a lip on the upper end of the receptacle neck 16 to insure an air tight closure when tightened.

Figure 17:
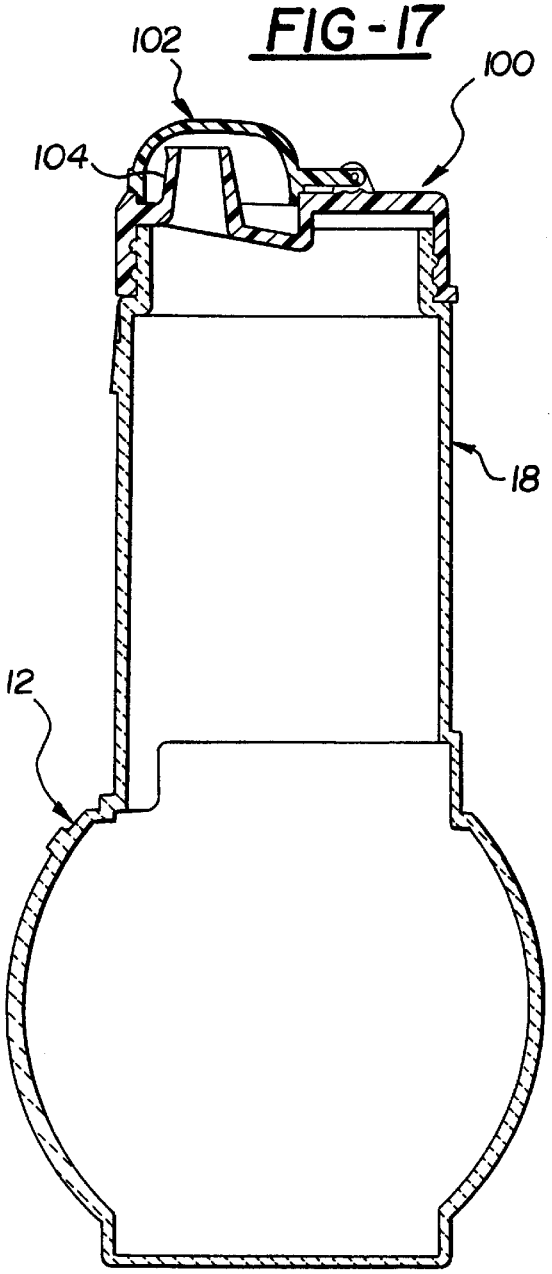
FIG. 17 is a sectional view of the receptacle with the cap and cover removed and replaced with a butter pourer cap.

FIG. 17 shows a pouring spout cover 100 which can replace cap 18 when the receptacle 12 is used to hold microwave melted butter, a snap fit cover 102 overlying a pouring spout 104 when closed.

Figure 18:
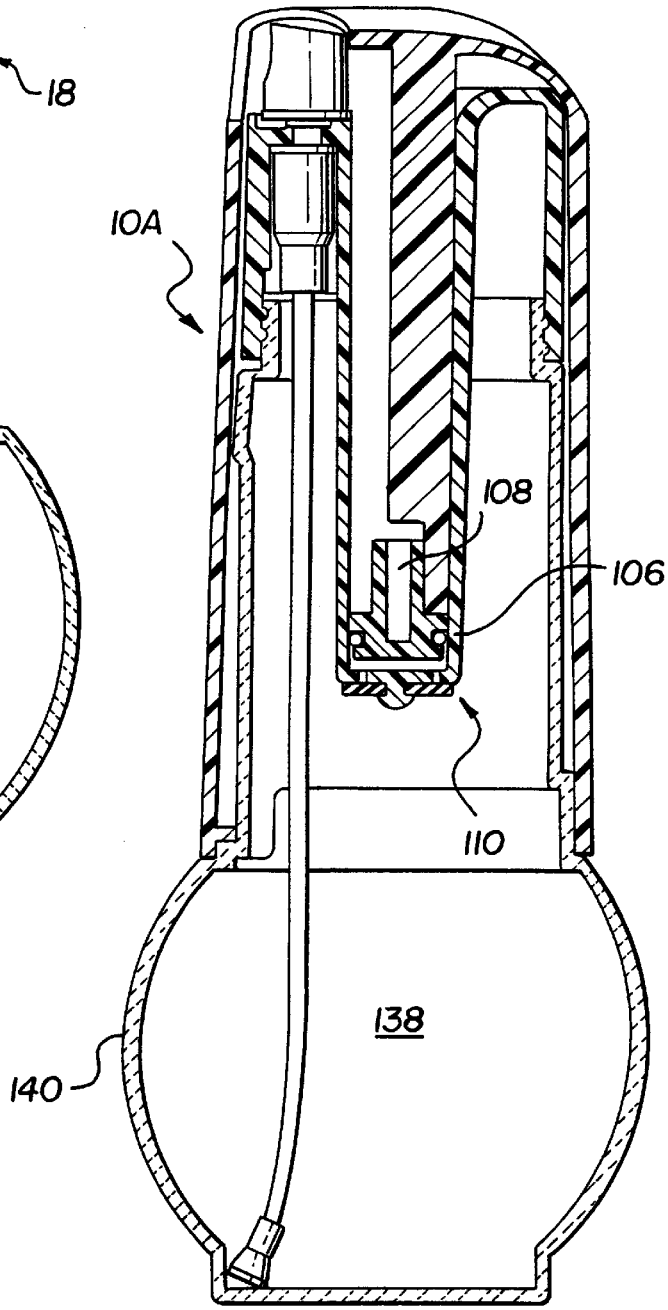
FIG. 18 is a sectional view of a sprayer according to the invention incorporating another form of air seal-valving associated with the pumping tube and piston.

FIG. 18 shows a sprayer 10A incorporating a second, preferred form of the piston check valve 106 and piston end structure 108 and tube check valve 110.

The piston end structure 108 is formed with a spool shape defined by a pair of disc shaped portions 112, 114 axially spaced apart to create an annular space 116 in which is disposed an elastomeric O-ring 118 which is of a diameter sufficient to engage the inner tube wall 126. Four holes 120 extend axially through the lower disc portion 114 and into the annular space 116. The holes 120 extend into a central portion 121 connecting the disc portions 112, 114 in the region of the annular space 116.

The O-ring 118 is of a smaller thickness than the depth of the space 116 to create a clearance between the respective radial faces 122, 124 of disc portions 112, 114 and the O-ring 118. The O-ring 118 has larger diameter than the diameters of the radial faces 122, 124 to sealingly engage the tube wall 126.

Figure 19A:
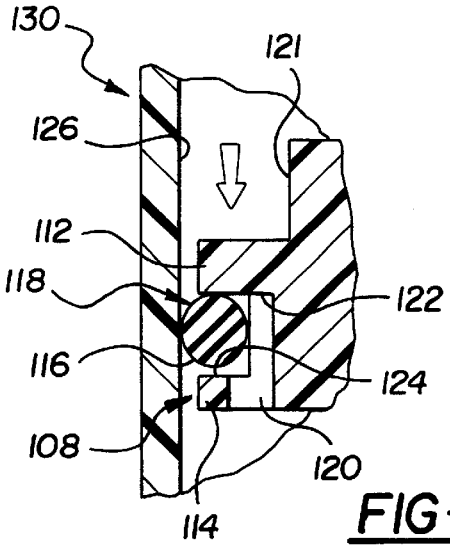
FIG. 19A, 19B are enlarged section view of a piston and O-ring functioning as a one way valve associated with the piston, shown in two operative positions.

During the downstroke shown in FIG. 19A, the O-ring 118 is forced against the radial face 122 of disc portion 112, creating a seal with tube wall 126, preventing any air from passing by the piston structure 108, so that air can be pumped down the tube and into the receptacle space, through check valve 110.

Figure 19B:
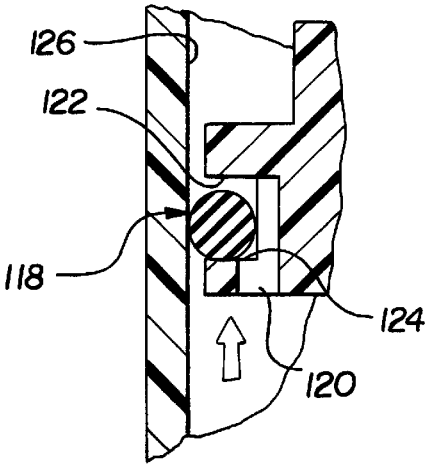

During the upstroke, shown in FIG. 19B, the O-ring 118 moves against the lower face 124, creating a clearance space with face 122, allowing air to move past the outside of the radial portion 112, around the O-ring 118 and out through the holes 120 into the space beneath the piston structure 108 and above the check valve 110.

The check valve 110 comprises a flat elastomeric disc 128 heat staked to the end wall 132 of the tube 130 which may be slightly dished inwardly which is overlain by the compliant elastomeric washer 128. Four holes 134 extend through the end wall 132, so that when the air is pushed down in the tube 130, the compliant sealer disc 128 is deflected off holes 134 to allow air to be pumped into the interior 138 of the receptacle 140

When the piston 108 moves back up, the disc 128 reseats over the holes 134 to prevent the pressurized air in the space 138 from escaping.

Referring to FIG. 23, a filter 142 may be mounted on the draw tube 58, which includes a main body 144 into which the draw tube 58 is pressed.

A flared shirt 144 has a screen filter disc pressed into an interior groove.

What is claimed is:

1. A liquid sprayer comprising:

a receptacle defining an interior space for receiving a liquid to be sprayed, said receptacle having an open top to allow liquid to be introduced into said interior space;

a removable cap mounted on said top to close off said interior space;

a cover slidably received over the cap;

an air pump formed by components on said cap and cover operated by stroking of said cover on said cap to force atmospheric air under pressure into said interior space, said air pump including valving components retaining pressurized air within said interior space;

a spray nozzle assembly mounted in said cap selectively allowing spraying of liquid from said interior space under air pressure developed by said air pump within said interior space;

said spray nozzle including a plunger protruding above said cap;

said cover having an opening therein allowing finger access to said plunger;

said cover having features interfit to prevent stroking in at least one rotated position of said cover, said opening in said cap aligned with said spray nozzle plunger when said cover is in said rotated position, said cover rotatable to another position whereat said features are not interfit to allow said stroking of said cover.

2. The liquid sprayer as set forth in claim 1 wherein said receptacle has an elongated upright neck over which said cover extends and wherein said features include raised areas on said neck defining a recess and a protrusion on the inside of said cover received in said recess.

3. The liquid sprayer as set forth in claim 1 wherein said cover is rotatable to a third position covering said nozzle plunger and whereat said features are interfit to prevent stroking.

4. The liquid sprayer as set forth in claim 3 wherein said cover has markings indicating each rotated position.

5. The liquid sprayer as set forth in claim 1 wherein said cap has a central tubular portion projecting within said receptacle and open at the end to communicate with said interior space, and open to the atmosphere at the upper end of said cover has an elongated piston formed thereon projecting into said tubular portion and slidable thereon, said piston carrying a seal at one end to allow air to be pumped by motion of said piston and a valve opening to allow air to be drawn past said piston on an upstroke and closing to allow air to be forced through said tubular portion into said interior space upon a downstroke of said piston; and a check valve on said tubular portion lower end retaining air under pressure in said interior space.

6. The liquid sprayer as set forth in claim 5 wherein said spray nozzle assembly is offset to one side from said tubular portion.

7. The liquid sprayer as set forth in claim 5 wherein said valve on said piston comprises an O-ring engaging the inside of said tubular portion and received in an annular recess extending around said piston, said recess wider than said O-ring to allow axial motion of said O-ring upon stroking of said cover and piston to be shifted against respective side portions defining said recess; and passages opened when said O-ring is shifted by an upstroke motion of said piston to allow air to be drawn past said piston and into said tubular portion, and closed by shifting of said piston on said downstroke of said piston.

* * * * *

UNITED STATES PATENT AND TRADEMARK OFFICE

CERTIFICATE OF CORRECTION

PATENT NO. : 6,283,335 B1
DATED : September 4, 2001
INVENTOR(S) : Michael W.K. Young et al.

It is certified that error appears in the above-identified patent and that said Letters Patent is hereby corrected as shown below:

Column 3,
Line 15, after "onto threads" insert -- 20 --.

Column 4,
Line 6, delete "32" insert therefor -- 34 --.
Line 7, delete "position" insert therefor -- portion --, and after "90, and" delete "a".
Line 8, after "92," insert -- which --.

Column 5,
Line 27, delete "cap" insert therefor -- cover --.

Signed and Sealed this

Twenty-eighth Day of May, 2002

*Attest:*

*Attesting Officer*

JAMES E. ROGAN
*Director of the United States Patent and Trademark Office*